United States Patent [19]

Rump et al.

[11] Patent Number: 4,945,705

[45] Date of Patent: Aug. 7, 1990

[54] STIFFENING FOR BOX GIRDERS OR BEAMS

[75] Inventors: Peter Rump, Schwerte; Juergen Schmitt, Witten, both of Fed. Rep. of Germany

[73] Assignee: Mannesmann AG, Duesseldorf, Fed. Rep. of Germany

[21] Appl. No.: 855,609

[22] Filed: Apr. 23, 1986

[30] Foreign Application Priority Data

Apr. 24, 1985 [DE] Fed. Rep. of Germany ..... 3514786

[51] Int. Cl.[5] ..... E04C 3/30

[52] U.S. Cl. ..... 52/731; 52/793

[58] Field of Search ..... 52/731, 793, 799, 807

[56] References Cited

U.S. PATENT DOCUMENTS

| | | | |
|---|---|---|---|
| 1,360,774 | 11/1920 | Mooney et al. | 52/731 |
| 2,125,691 | 8/1938 | Ragsdale et al. | 52/731 |
| 2,843,725 | 7/1958 | Granberg | 52/731 X |
| 2,941,635 | 6/1960 | Harris | 52/731 X |
| 3,108,665 | 10/1963 | Marchand | 52/695 X |
| 3,158,236 | 11/1964 | Caligiuri | 52/731 |
| 3,167,851 | 2/1965 | Cowan | 52/731 X |
| 3,257,764 | 6/1966 | Cripe | 52/731 X |
| 3,332,197 | 7/1967 | Hinkle | 52/731 |
| 3,965,942 | 6/1976 | Hatch | 52/793 X |
| 4,109,440 | 8/1978 | Bill | 52/731 X |
| 4,580,380 | 4/1986 | Ballard | 52/731 X |

FOREIGN PATENT DOCUMENTS

| | | | |
|---|---|---|---|
| 37288 | 3/1969 | Finland | 52/731 |

*Primary Examiner*—David A. Scherbel
*Assistant Examiner*—Creighton Smith
*Attorney, Agent, or Firm*—Ralf H. Siegemund

[57] ABSTRACT

Box girders or beams with lateral webs arranged between upper and lower cords or flanges and stiffened by an arrangement which includes at least one stabilizing triangle established by angle pieces, triangular sleeves, bent rods or sheets with crossing bent of tongues.

6 Claims, 2 Drawing Sheets

Fig. 6
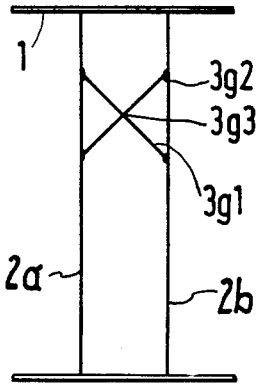
Fig. 7
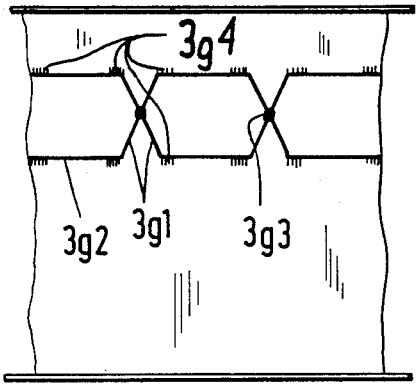
Fig. 8
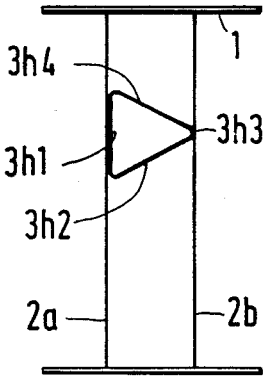
Fig. 9
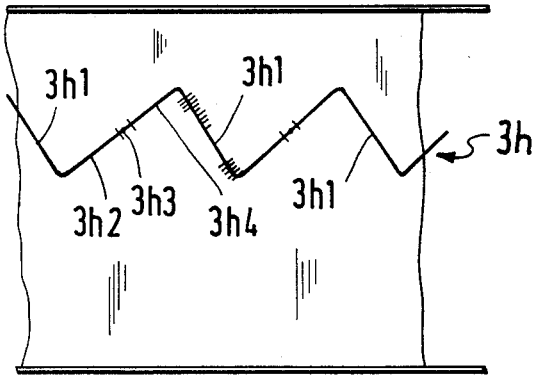
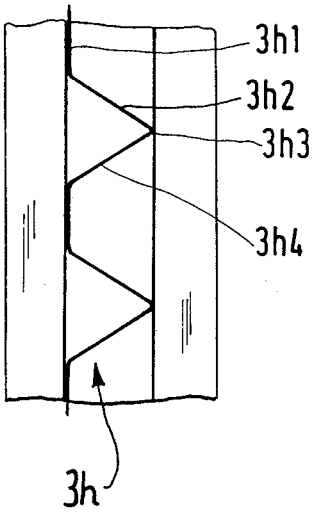
Fig. 10

STIFFENING FOR BOX GIRDERS OR BEAMS

BACKGROUND OF THE INVENTION

The present invention relates to a box beam or girder, particularly for cranes, with lateral web sheets between upper and lower (or top and bottom) flanges and wherein particularly stiffening structures are provided between the side or web sheets.

Box beams or girders of the type to which the invention pertains exhibit the phenomenon that the web or web sheets are subjected to forces tending to create local indent and bulges. However, by putting longitudinal bar-like section pieces on the inside of the "box" and welding them thereto, this kind of deficiency can be avoided. Different loads as far as the moving parts of the crane are concerned, inertia forces generally, and horizontal loads at the flange, all are factors having to do with the introduction of forces into the beam and girder and the general task exists to distribute these forces into and throughout the structure in its entirety. For this one normally provides transversely arranged bulkhead-like bars or sheets being welded to the web sheets and the flanges in the box girder or beam. The manufacture of box girders or beams and being stiffened in that manner is very expensive and requires a large amount of work, particularly for providing and placing the bulkhead-like stiffening sheets

DESCRIPTION OF THE INVENTION

It is an object of the present invention to provide a new and improved box-type girder or beam, first under consideration that lateral web or web sheets are to be provided, and that in addition some stiffening is also to be provided for, between these web or web sheets. The improvement is to involve little expenditure, and the load capabilities of the device should be guaranteed, particularly as far as reaction of and distribution of forces is concerned In accordance with the preferred embodiment of the present invention it is suggested to arrange a stiffening structure that extends in longitudinal direction of the box-like girder or beam, and to interconnect the lateral web or web sheets, possibly also an upper flange, so that, as far as a cross-section through the girder and the stiffening structure is concerned, at least one stabilizing triangle obtains, running in the length direction of the girder; the length direction being at right angles to any plane which contains the triangle or triangles or into which such a triangle or triangles can be projected. The triangle or triangles replace the reinforcement as of the prior art while being stiff in their entirety in conjunction with the box girder and beam and extending throughout the girder or beam structures. Also, any transversely arranged bulkheads are no longer needed because any of the triangles will not on transverse loads. This is in contradistinction to a rectangle which may indeed be deformed into a parallelogram.

The inventive stabilizing triangles may be established through angle or triangular profiles, with or without direct participation of one or both of the web sheets. Free ends or legs may be welded to one of the web sheets, an angle edge or corners are welded to the oppositely located web or web sheets, possibly also to the upper flange. Alternatively, the stabilizing triangles, may be established through sheet metal configured by having staggerdly arranged and differently oriented sections or tongues, the longitudinal edges of which are welded to the web or web sheets in different levels or elevations and alternatingly to different sides. Still alternatively the stabilizing triangles may be established through suitably bent rods. In all these various configurations and modifications thereof the essential aspect is and remains the establishing of stabilizing triangles.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken In connection with the accompanying drawings in which:

FIG. 6 illustrates an end view of box girder or beam with crossing rods;

FIG. 7 is an inside, side elevation of the structure shoWn in FIG. 6;

FIG. 8 illustrates an end view of a box girder or beam using a single stiffening rod which has been deformed to establish a triangle;

FIG. 9 is an inside side view of the stiffening rod shown in FIG. 8;

FIG. 1O is a top elevation of the stiffening rod shown in FIG. 8, with the upper flange being removed.

Figure 1:
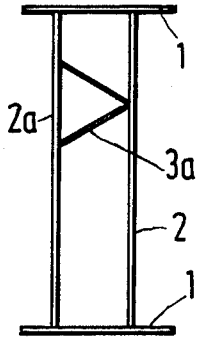
FIG. 1 is an end view of a box girder or beam with stiffening by means of an angle profile in accordance with a preferred embodiment of the present invention for practicing the best mode thereof.

Proceeding now to the detailed description of the drawings, FIG. i illustrates a box girder or beam having upper (top) and lower (bottom) flanges or chords 1 being interconnected by means of web or web sheets 2*a* and 2*b* constituting, so to speak, side walls of the box. Reference numeral 3*a* illustrates a section profile which is intermittently welded to the two sheets 2*a* and 2*b*. The triangle proper is established by the angle piece 3*a* extending for the length of the girder or beam, and by that portion (2*a*') of the left hand web or web sheet 2*a* which is situated between the ends of the legs of the angle piece 3*a*, these ends being welded to the web or web sheets 2*a*. The corner edge of the angle piece 3*a* is welded to web sheet 2*b*.

This triangle in fact avoids and prevents distortion of the rectangular contour of the box girder or beam as seen in the section view of FIG. 1, into a parallelogram, and thus establishes the requisite stiffness of the sheets 2*a* and 2*b* in relation to each other, as well as in relation to upper and lower stringer portions 1.

Figure 2:
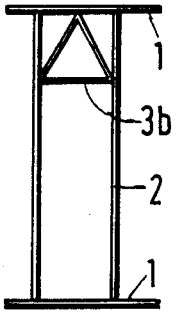
FIG. 2 shows a box girder or beam with stiffenings by means of directly established triangular configurations.

Basically the same effect obtains by means of the full triangular section piece 3*b*, as configured and shown in FIG. 2. One "point" of the triangle is here welded to the upper flange 1, as well as to the two web or web sheets 2*a* and 2*b*. Welding is again provided in sections or discrete portions, and does not have to be a through seam for the length of the box girder or beam.

Figure 3:
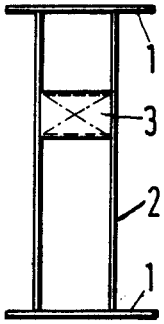
FIG. 3 illustrates a similar view of a box girder or beam with corrugated stiffening sheets arranged in between the web or web sheets, and wherein supplemental
Figure 3A:
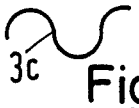
FIGS. 3*a*, 3*b* and 3*c* show different types of corrugation.
Figure 3B:
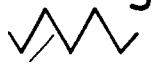
Figure 3C:
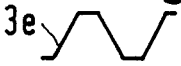

As shown in FIG. 8, corrugated section pieces 3 are interposed between the two web or web sheets 2a, 2b. That particular device 8 may be configured as a regular, corrugated sheet 3c with rounded corrugations as shown in FIG 3a, or it maY be a zig-zag tYpe corrugation shown in FIG. 3b, section 3d. Still alternatively a trapezoidal kind of corrugation 3e, as shown in FIG. 3c, can be used. The dash-dot lines in FIG. 8 indicate by way of crossing how the triangles are established as a consequence of using these types of sections They are to be considered surface geometric lines on and in these corrugated sections.

Figure 4:
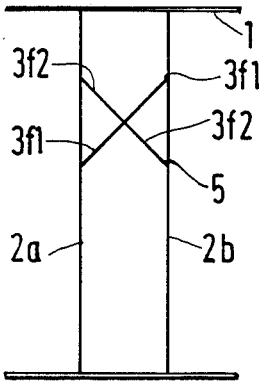
FIG. 4 illustrates an end view of box girder or beam with a single stiffening sheet.

FIGS. 4 and 5 illustrate again the box girder or beam structure using upper and lower flange parts and sidewalls or web sheet 2a and 2b. Here then stabilizing triangles are established through a single but sectionalized sheet 3f. The sheet or flat bar has bent off tongues 3f1, which run from a central portion of the web or web sheet 2a to the upper portion of web or web sheet 2b. In addition, there are sections or tongues 3f2 which cross the sections 3f1 in a projection as can be seen in FIG. 4, and these sections 3f2 have an upper edge part connected (welded) to an upper part of sheet 2b, while the lower edge of that tongue 3f3 is connected to a middle portion of sheet 2b.

Figure 5:
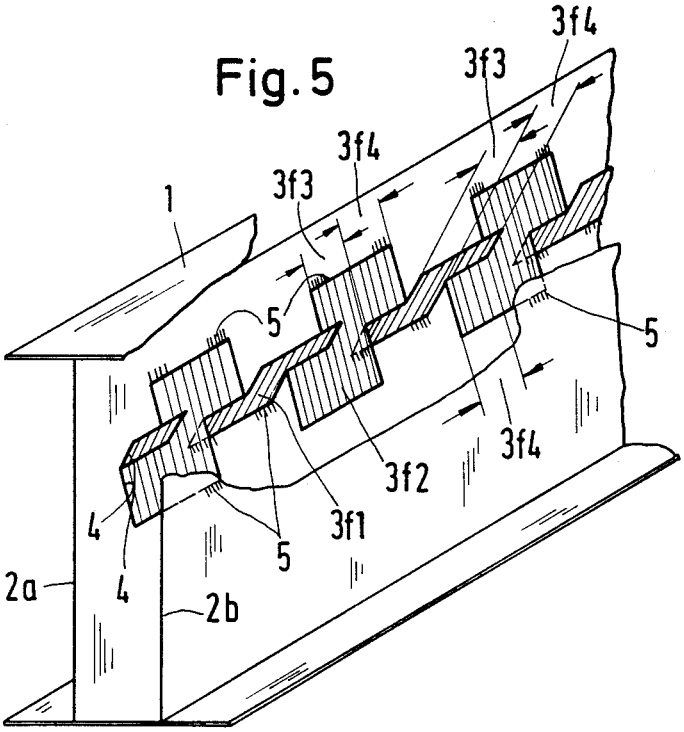
FIG. 5 illustrates the device shown in FIG. 4 but in a perspective view.

The two sections or tongues 3f1 and 3f2 each have a have straight area which together run (longitudinally) all the way through without interruption These tongues in projection, cross at right angles. Moreover, each tongue such as 3f2 has (i) a straight portion 3f3 that extends obliquely from one side 2a (or 2b) to the other one 2b (or 2a); and (ii) two angled portions such as 3f4 with a complimentary, V-defining part that actually pertains to the next tongue 3f1. All these portions 3f1 and 3f4 are of equal length. The kind of angling is shown in FIG. 5, particularly at the point or points 4.

The welding seams 5 between the web or web sheets 2a and 2b on one hand and the sections 3f1 and 3f2 on the other hand, are primarily required at the end of the latter. The sheets 3f, particularly the angled off or V-shaped parts 3f4 together with web sheets 2a and 2b establishe triangles.

In addition, the straight sheet portions 3f3, also taken together with the web sheets 2a and 2b and the upper and lower parts 1 establish trapezoidal polygons.

The example shown in FIGS. 6 and 7 illustrates stabilizing triangles established by two, somewhat intertwined and crossing rods 3g, the crossing occurs in oblique transverse portions 3g1 of the rods. The reference numeral 3g3 indicates welding points as between crossing rods at the point of crossing. FIG. 7 particularly illustrates the oblique orientation of these crossing portions of the rods. The longitudinal parts 3g2 of the rods 3g has its end portions welded to the web or web sheets 2a and 2b; reference numeral 3g4 identifies those welding points.

In the embodiment shown in FIGS. 8, 9 and 10, stabilizing triangles are established by a single rod 3h. The rod part 3h1 abuts the left hand sheet 2a and is welded thereto in discrete welding zones. From the portion 3h1 an angled off part of the rod establishes the first transverse portion 3h2. The end of that portion engages the other web or web sheets, 2b, and is welded thereto at 3h3. From the welding point 3h3 another transverse rod portion extends back towards web sheet 2a and is identified by reference numeral 3h4, following which there is another portion 3h1 being longitudinally offset from the first one, as can be seen from FIG. 9 by the wavelength pattern of this multiply bent rod 31. It can thus be seen that, just as the angled profile 3a together with one of the sheets, such as 2a in FIG. 1, establishes a triangle, rod 3h performs a similar task and prevents shifting and distortion of the rectangle established by the upper flange I and the sidewall and web sheets 2a and 2b, so that the formation of a parallelogram again is prevented.

As far as the dimensions are concerned, box beam and girders are normallY up to about 700 mm high, and the inside dimensions are between 90 and 300 mm, so that even for the smallest distance between the web sheets, sufficient space is provided to insert and weld the various pieces and stiffening parts, for purposes of forming triangles as described. The welded on or welded in stabilizing triangles as described impart adequate strength and stiffness upon the box beam and girder. Particularly in case upper and lower flange parts experience different vertical loads or the device as a whole is subject to torsional forces or, for some reason or another the tendency exists to indent the web or web sheets. All these instances are adequately dealt with by the simple stiffening structures as per the present invention.

The invention is not limited to the embodiments described above, but all changes and modifications thereof not constituting departures from the spirit and scope of the invention, are intended to be included.

We claim:

1. Box girder or beam with two lateral side webs arranged between upper and lower cords or flanges and facing each other across a box interior, a stiffening arrangement comprising:

means for stiffening being a longitudinal single sheet composed of crossing, angled off parts staggerdly arranged and alternatingly welded to one and the other of the two webs and extending in longitudinal direction as far as the beam and girder is concerned and between said two side webs such that in cross section at least one stabilizing triangle is established having a profile and extension which runs in longitudinal direction, the triangle including at the most one of said webs as one side of the triangle so that at least two sides of the triangle are established by the means for stiffening.

2. Box beam or girder as in claim 1 said longitudinal sheet having tongues including straight portions extending from one web towards the other, and in between portions are V-shaped and have their ends also welded to the two webs.

3. Beam or girder as in claim 2 angling of adjacent straight tongues mounting to approximately 90 degrees.

4. Box girder or beam with two lateral side webs arranged between upper and lower cords or flanges and facing each other across a box interior, a stiffening arrangement comprising:

means for stiffening including a plurality of rods arranged in crossing relationship connected with opposite ends to said webs respectively and being interconnected where crossing and extending in longitudinal direction as far as the beam and girder is concerned such that in a projection into a cross section plane through the webs, at least one stabilizing triangle is established having a profile and extension which runs in longitudinal direction, such a triangle including one of said webs as one side of the triangle so that at least two sides of the triangle are established by the crossing rods.

5. Box girder or beam with two lateral side webs arranged between upper and lower cords or flanges and facing each other across a box interior, a stiffening arrangement comprising:

means for stiffening extending in longitudinal direction as far as the beam and girder is concerned and between said two side webs, and including a plurality of rods interconnecting said webs with opposite ends and oriented so that stabilizing triangles form in a projection transversely to the direction of extension of the beam or girder, each triangle including only one of said webs as one side of the triangle so that at least two sides of the triangle are established by the rods of the plurality.

6. Box girder or beam with two lateral side webs arranged between upper and lower cords or flanges and facing each other across a box interior, a stiffening arrangement comprising:

means for stiffening extending in longitudinal direction as far as the beam and girder is concerned and between said two side webs, including a single rod having plural bent off portions welded alternatingly to said webs so that in a projection transverse to a direction of extension of the beam of girder, triangles form, each triangle including just one of said webs as one side of the respective triangle, so that at least two sides of the triangle are established by the single rod.

* * * * *